US005725087A

United States Patent [19]

Ives

[11] Patent Number: 5,725,087

[45] Date of Patent: Mar. 10, 1998

[54] ROTARY SWITCH THAT CONVERTS TO ROTARY ACTION, A TOGGLE STYLE SWITCHING MECHANISM

[75] Inventor: Milton N. Ives, Stuart, Fla.

[73] Assignee: Carlingswitch, Inc., Plainville, Conn.

[21] Appl. No.: 726,809

[22] Filed: Oct. 7, 1996

[51] Int. Cl.[6] ..... H01H 21/80

[52] U.S. Cl. ..... 200/330; 200/336; 200/564; 200/316

[58] Field of Search ..... 200/564, 568, 200/558, 336, 316, 330, 529, 437

[56] References Cited

U.S. PATENT DOCUMENTS

| | | | |
|---|---|---|---|
| 2,252,829 | 8/1941 | Bell | 200/330 |
| 3,356,819 | 12/1967 | Zavertnik et al. | 200/336 X |
| 3,482,067 | 12/1969 | Sanford | 200/437 |
| 5,105,059 | 4/1992 | Sorenson | 200/339 X |
| 5,336,861 | 8/1994 | Cummins et al. | 200/558 X |
| 5,359,165 | 10/1994 | Leveque et al. | 200/564 X |

FOREIGN PATENT DOCUMENTS

| | | | |
|---|---|---|---|
| 406005192 | 1/1994 | Japan | 200/336 |
| 685381 | 12/1939 | United Kingdom | 200/331 |

*Primary Examiner*—Renee S. Luebke

*Attorney, Agent, or Firm*—McCormick, Paulding & Huber

[57] ABSTRACT

An electric switch for converting to rotary motion a rocker style switching mechanism. A switch cavity is formed in the case and a movable contact is provided in the switch cavity. A knob is coupled to an actuator mounted in the cavity for positive pivotal movement on a lateral axis. The knob contains cams formed in an interior knob cavity and is mounted on the switch so that when the knob is rotated on an axis perpendicular to the pivot axis of the actuator, the cams engage the actuator to move the movable contact between "ON" and "OFF" positions.

19 Claims, 8 Drawing Sheets

ROTARY SWITCH THAT CONVERTS TO ROTARY ACTION, A TOGGLE STYLE SWITCHING MECHANISM

FIELD OF THE INVENTION

The invention relates generally to rotary switches and deals more specifically with the conversion to rotary action of a "rocker" or toggle style switching mechanism of the type shown in U.S. Pat. No. 5,105,059.

BACKGROUND OF THE INVENTION

Rocker or toggle style switching mechanisms are very popular as a result of the simplicity of their construction when taken together with the reliability of their operation. Such switching mechanisms comprise a movable contact lever that is generally pivoted and moves between stable limit positions that are either "ON" and "OFF" in a two position switch or "ON"/"ON" in a center "OFF" or three position switch. A pivoted actuator is provided for moving the contact lever between these limit positions, and a spring loaded plunger provided in the actuator maintains contact between the movable contact lever and the pivoted actuator in the switch case housing.

Rotary switches, on the other hand, tend to be somewhat more complicated in their structure and require a greater number of parts, which parts are generally assembled only with a greater degree of difficulty. Furthermore, rotary switches generally do not exhibit the same degree of reliability over long periods of use.

The present invention seeks to provide a rocker or toggle type switching mechanism which is adapted for operation by rotating a knob on the switch housing. One advantage to providing a switch case housing that has elements common to both a rocker switch and a rotary switch is that the switch manufacturer and even the distributor of such switches need stock fewer total parts to meet a wider variety of customer's needs for switches in general.

SUMMARY OF THE INVENTION

It is the general purpose and object of the present invention to provide an improved rotary switch capable of converting to rotary motion a rocker style switching mechanism.

It is a further object of the present invention to accomplish the aforementioned conversion of a conventional rocker mechanism by providing a rotary knob with unique cams such that upon rotation of the knob, the cams will engage an actuator in a conventional rocker type switch, to provide stable limiting positions where the knob is releasably held in place by the rocker style switch mechanism.

It is yet a further object of the present invention to provide an indicating means on the switch corresponding to the switch position, the indicating means being visible through an opening in the switch knob.

These objects are accomplished with the present invention by providing a unique switch comprising a switch case or housing having an upwardly open cavity defined by a bottom wall in which openings are provided for terminals, laterally spaced front and rear walls, and opposed end walls all of which are integrally connected to the bottom wall and to each other. The case further includes a top cover in communication with the front, rear, and opposed end walls such that the upwardly open cavity is closed off. A socket is defined by a central opening that extends through the top cover. At least one movable contact is provided in the enclosed switch cavity. An actuator is provided in the enclosed switch cavity and is pivotally mounted with the top cover for movement along a lateral axis. The actuator includes, a downwardly depending portion which contacts the movable contact, and an upwardly extending portion which passes through the central opening in the top cover. A knob is mounted for rotation on the switch about an axis oriented perpendicular to the lateral axis of the actuator. Cam means, between the upwardly extending portion of the actuator and the knob, are provided so that rotation of the knob causes the cam means to act on the upwardly extending portion of the actuator such that the actuator pivots in the socket thereby causing the downwardly depending portion of the actuator to operate the movable contact. Accordingly, upon rotation of the knob to one of its predetermined limit positions, the upwardly extending portion of the actuator engages one of the cams thereby releasably retaining the actuator in a predetermined limit position.

In one preferred embodiment of the present invention, the cams are integrally formed in an interior recess of the knob.

In another preferred embodiment of the present invention, the knob includes an opening covered by a lens through which an indicator is visible. In yet another embodiment of the present invention, the knob includes an opening covered by a lens through which an indicator is visible.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENTS

Figure 1:
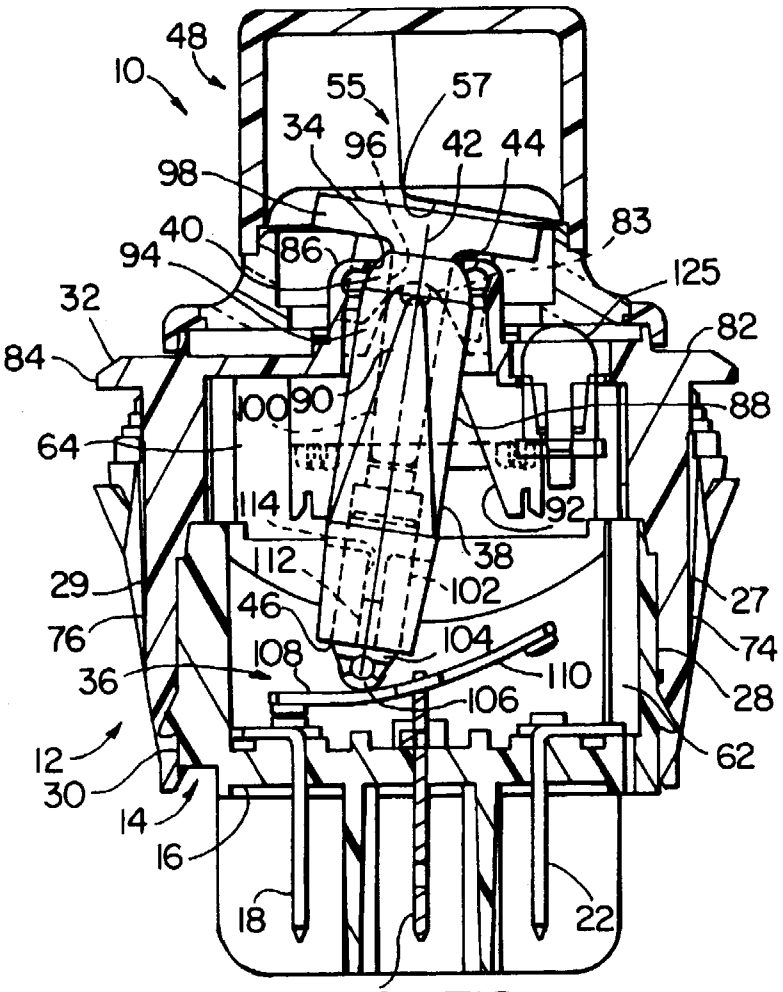
FIG. 1 is a front elevational view, partly in vertical section of a rotary switch embodying the present invention.

Referring now to the drawings in greater detail, FIG. 1 shows a first embodiment of the rotary switch 10 of the present invention. The present invention will be described with reference to the orientation of the switch as depicted in FIGS. 1 and 2 with the understanding that the terms upwardly and downwardly are relative when interpreting the scope of the claims as presented hereinafter.

The switch 10 comprises a switch case or housing 12 having an enclosed interior cavity defined by a bottom wall 16 in which openings are provided for terminals 18, 20 and 22. The case 12 also includes laterally spaced front and rear walls generally designated 19 and 21 in FIG. 2, opposed end walls generally designated as 27 and 29, FIG. 1 integrally connected to said bottom wall and to each other. A top cover or bracket 32 is also provided and communicates with the front, rear, and opposed end walls. The top cover defines a central opening 34 extending therethrough, and a socket is defined therein.

Figure 2:
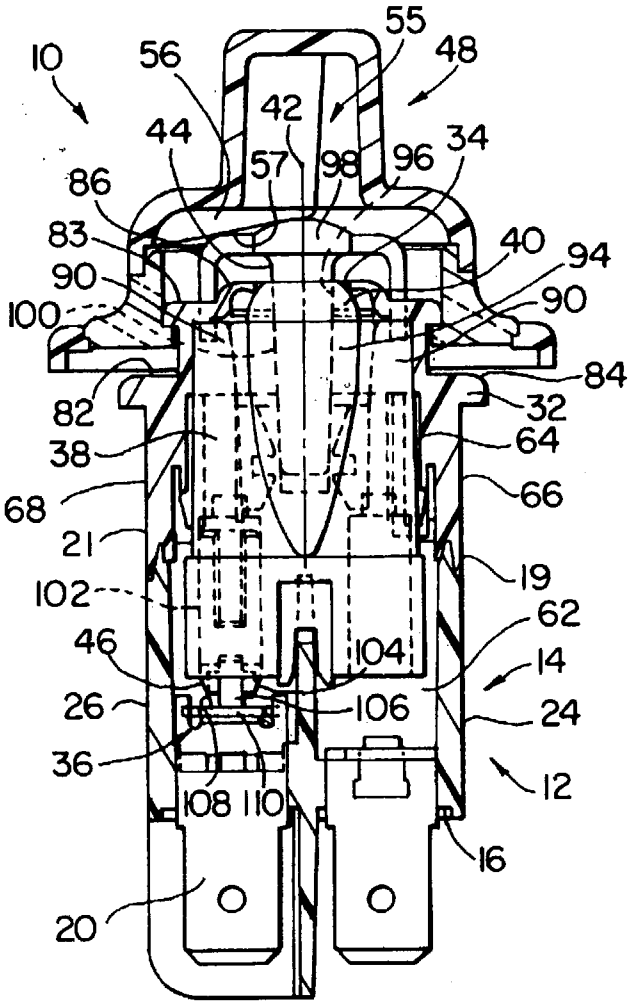
FIG. 2 shows a side elevational view, partly in vertical section of a rotary switch embodying the present invention.

Still referring to FIGS. 1 and 2, a movable contact 36 is provided for pivotal motion on center terminal 20. An actuator 38 has a pivot portion 40 mounted for pivotal motion about a lateral axis 42 defined by the socket in the top cover 32. An upwardly extending portion 44 of the actuator pivot portion 40 passes through the top cover central opening 34. The actuator 38 also has a downwardly depending portion 46 which engages the movable contact 36.

A knob 48 is rotatably mounted on the switch case 12 for rotation about an axis 50 which is oriented perpendicular to the pivot axis 42 of the actuator 38.

Figure 17:
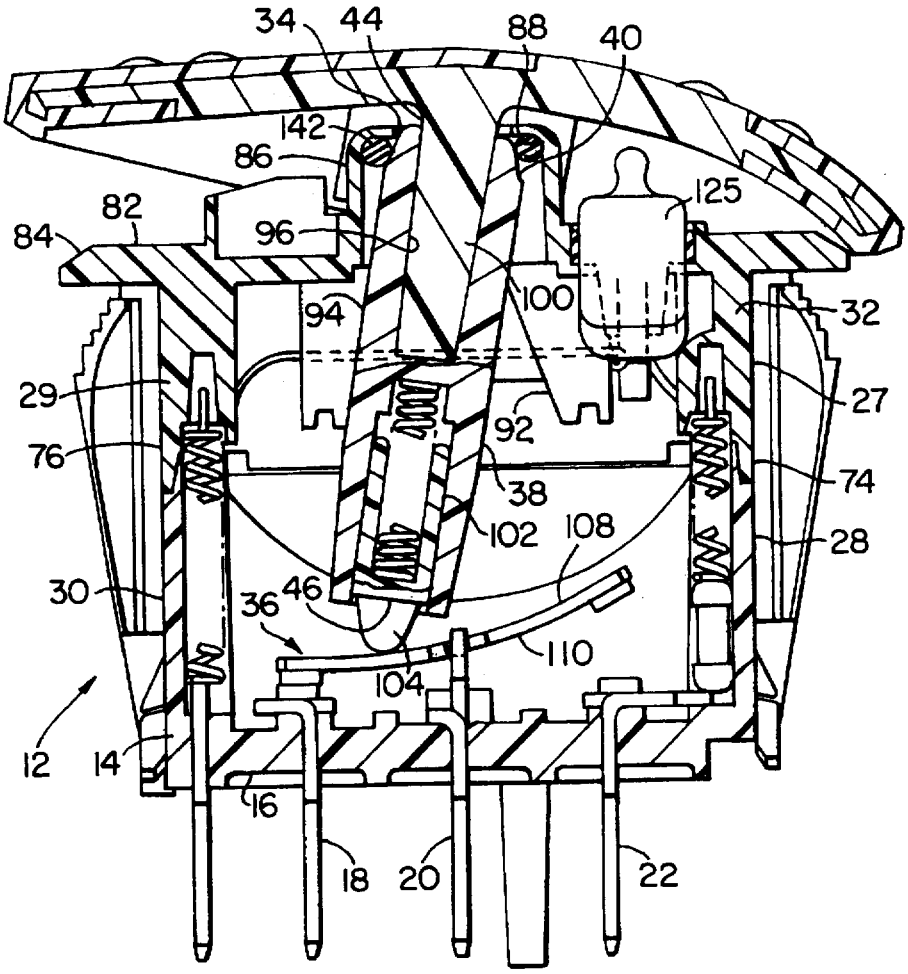
FIG. 17 PRIOR ART
FIG. 17 is a front elevational view, partly in vertical section of a conventional rocker type switch.

In the illustrated embodiment, as hereinafter described, the electric switch case or housing generally designated as 12, as well as the internal components of the switch, are of the type common to known rocker type switches. One such switch is shown and described in U.S. Pat. No. 5,105,059 ('059 patent) to Sorenson and Ives issued Apr. 14, 1992, and assigned to the assignee of the present invention. The '059 patent is hereby incorporated by reference as part of the present disclosure. The details of construction of the rocker type switch of the '059 patent are shown in FIG. 17 with components which are common to the switch of the present invention bearing the same element numbers. FIG. 17 illustrates the fact that the switch of the present invention includes several parts which are interchangeable with known rocker type switches thereby allowing manufacturers and distributors to fabricate and stock fewer parts.

Figure 3:
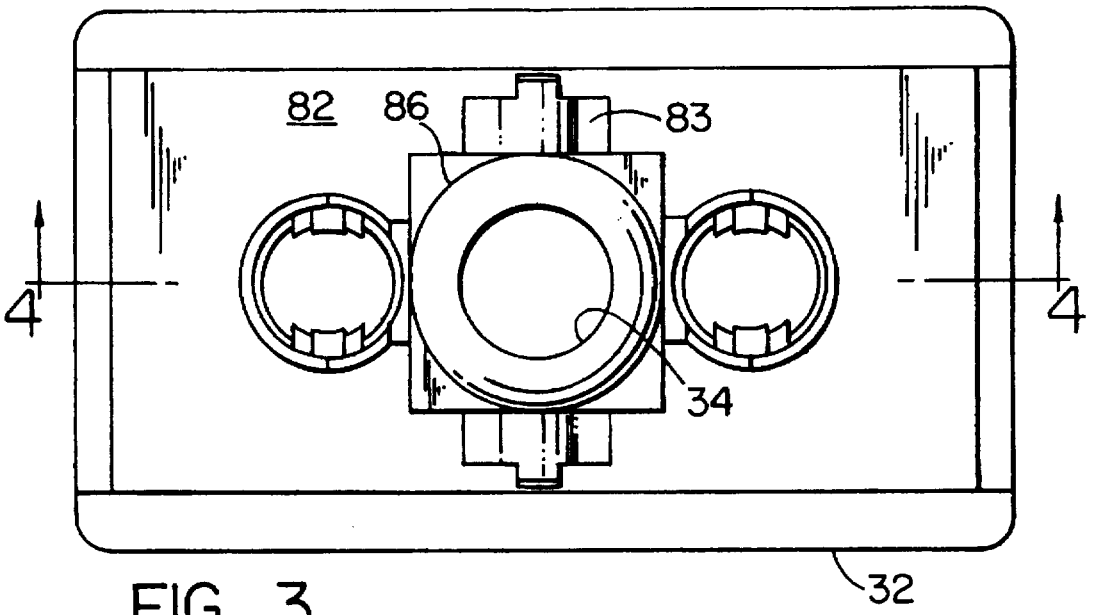
FIG. 3 is a top plan view of the top cover of the present invention of FIG. 1.
Figure 4:
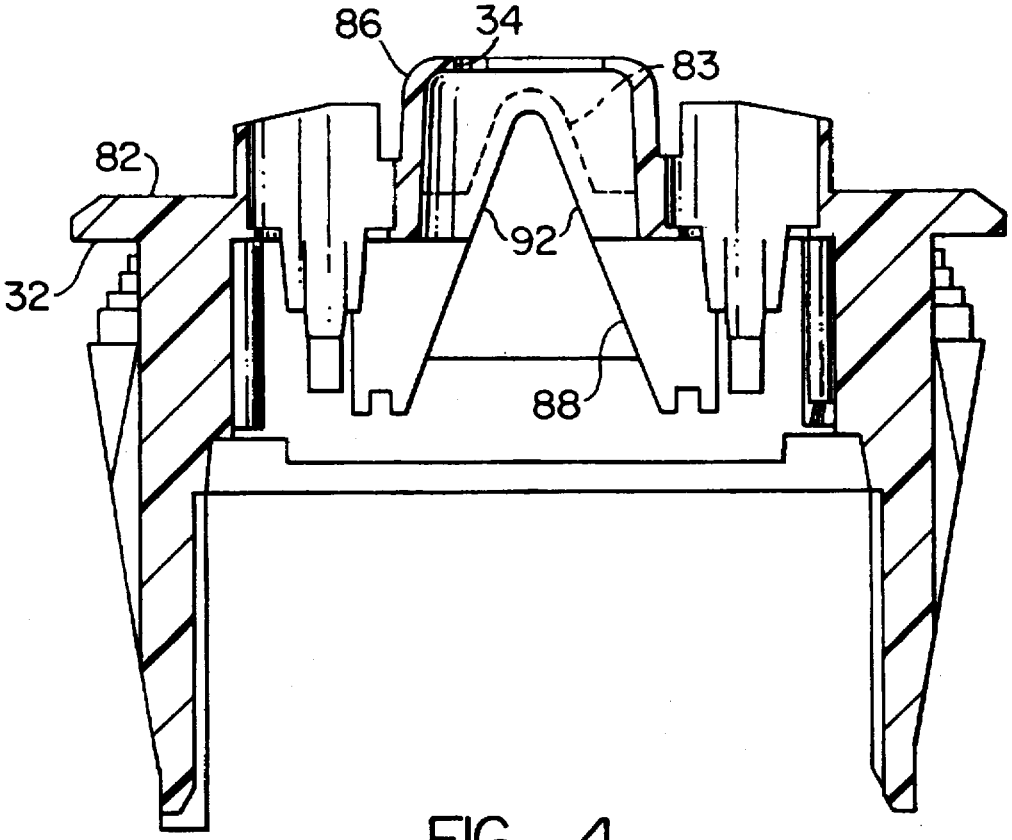
FIG. 4 is a vertical section of the bracket taken generally on line 4—4 in FIG. 3.
Figure 6:
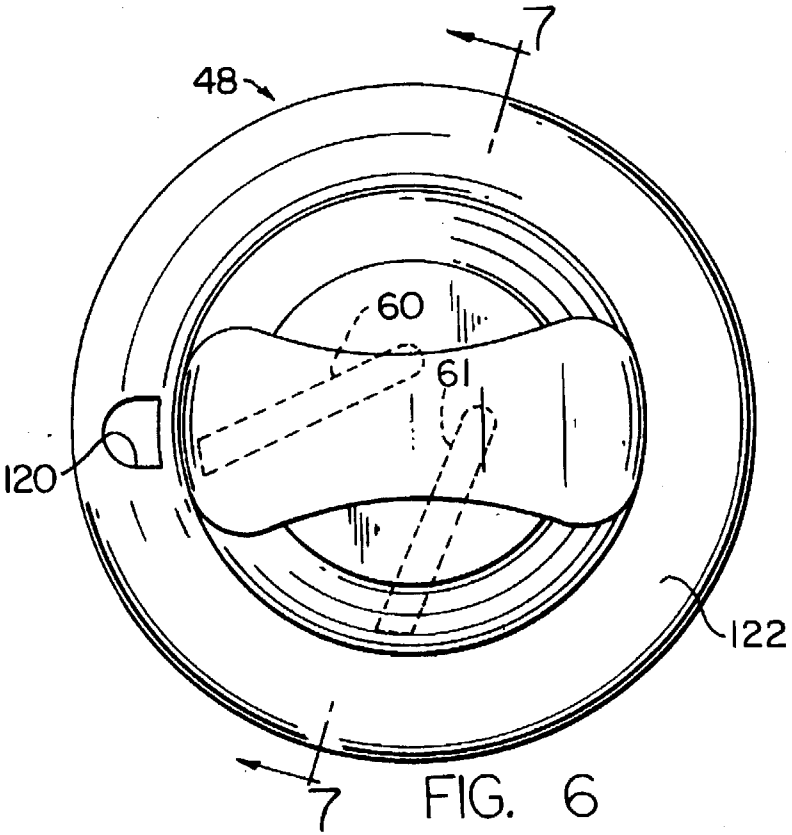
FIG. 6 is a top view of the knob of the present invention of FIG. 1.
Figure 5:
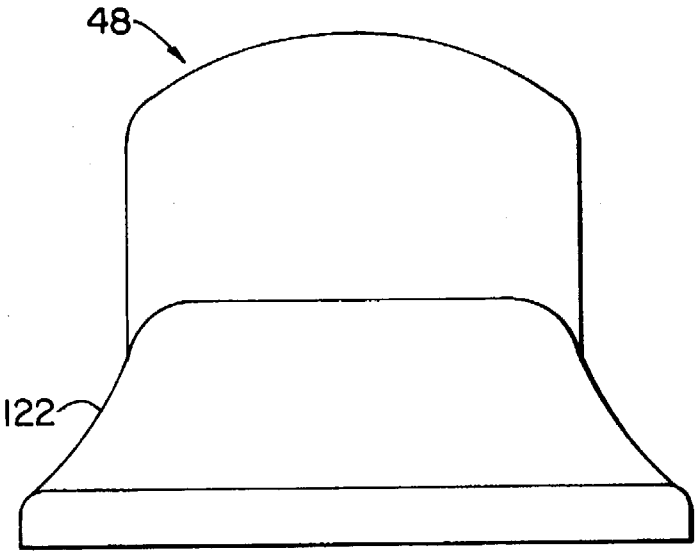
FIG. 5 is a front view of the knob of the present invention of FIG. 1.

Referring back to FIGS. 1 and 2, the housing 12 comprises an upwardly open base 14 having a bottom wall 16 in which openings are provided for various fixed terminals 18, 20 and 22. The base 14 also includes laterally spaced front and rear walls 24 and 26 respectively, FIG. 2, and opposed end walls 28 and 30, FIG. 1, all of which upstanding walls are integrally connected to one another and to the bottom wall 16 so as to define an upwardly open cavity 62. The bracket 32 includes integral front and rear walls 66 and 68 adapted to mate with the front and rear walls 24 and 26 of the base 14, and integral end walls 74 and 76 adapted to mate with the end walls 28 and 30 also of the base 14. Similarly to the walls of the base 14, the walls 66, 68, 74 and 76 of the bracket 32 are connected to one another and define a downwardly open cavity 64 that cooperates with the upwardly open cavity 62 to provide the enclosed interior cavity for housing the switch components. The bracket 32 has a top surface 82 which defines a peripherally extending flange 84 adapted to engage the outer face of a panel (not shown) that defines an opening of suitable rectangular shape for receiving the switch case. As best shown in FIG. 3, the top wall surface 82 of the mounting bracket 32 has a laterally extending central rib portion 83, illustrated at least in part in FIG. 2 and also shown in FIG. 4. An upstanding boss 86 is defined centrally of the top wall 82, and forms the center portion of the rib 83. The rib 83 further defines inner sockets 88, FIG. 4, for receiving actuator shoulder portions 90. The actuator 38 is provided inside the switch case and is constrained to move between limit stops 92 illustrated in FIG. 1.

Referring again to FIGS. 1 and 2, the actuator 38 has a center portion 94 defining a central opening 96. Additionally, the upwardly extending portion or rocker 44 has an upper section 98 with a post 100 positioned in the center of, and downwardly depending from, the upper section. The post 100 is of a complimentary shape such that it can be received in the central opening 96. At least one spring biased plunger 102 is provided in a downwardly open plunger recess or cavity provided in the center portion 94. An end 104 of the plunger 102 rotatably receives wheel 106. The wheel is urged into rolling contact with the upper surface 108 of the movable contact lever 110 by the spring biased plunger 102. In order to prevent rotation of the plunger 102 within the plunger recess cavity during actuation of the switch, the plunger recess includes key way 114 which serves to receive a key portion 112 of complementary shape provided on the plunger 102. In order to facilitate actuation of the switch, the movable contact 36 is pivotally mounted on the second fixed contact 20 such that movement of the actuator 38 between the two limit positions defined by the stops 92 will normally result in movement of the contact lever 110 to an opposite mirror image position.

Turning now to FIGS. 7 through 10, knob 48 has an interior knob cavity 52 defined by an interior cavity wall 54. Cam means, generally designated 55, FIG. 1, are defined in part by the actuator upwardly extending portion or rocker 44 and in part by the knob 48 and are responsible for the actuation of the switch 10. Cam portions generally designated as 56, FIGS. 8 through 11, which constitute part of the cam means 55 are formed integrally with the knob's cavity wall 54 and extend into the knob's interior cavity 52 so that they engage the upper section 98 of the rocker 44. These cam portions 56 have sloped surface 57, FIG. 2, for engaging the upper section 98 of the rocker 44. The switch 10 is actuated by rotating the knob 48, thereby causing the cam portions 56 to slide along the rocker's upper section 98 such that the sloped surface 57 coacts with the upper section 98 resulting in pivotal movement of the actuator 38 within the socket defined by the bracket 32, FIGS. 1 and 2.

Figure 8:
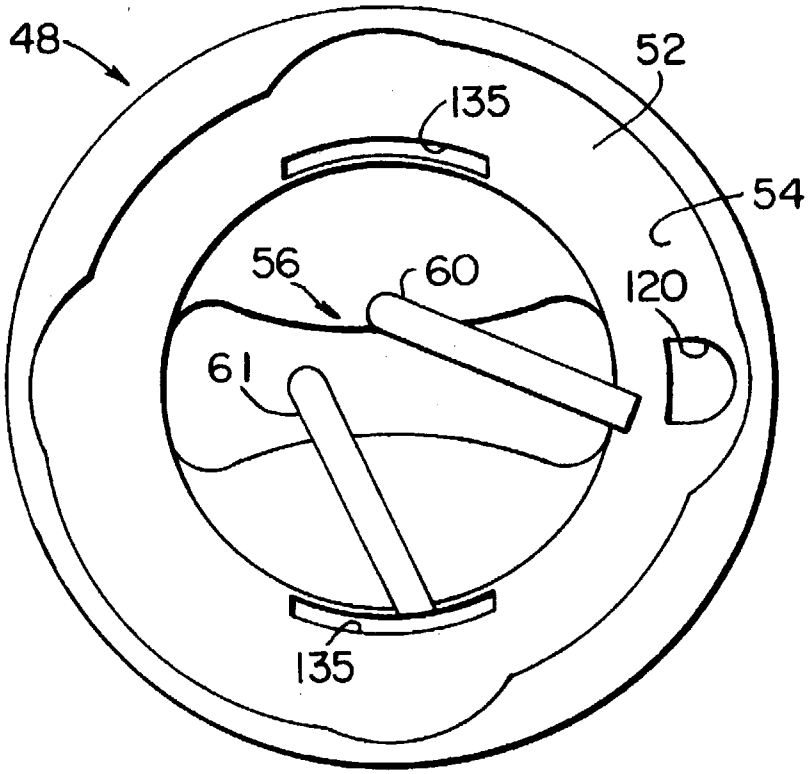
FIG. 8 is a bottom view showing the interior structure of an embodiment of the knob of the present invention.
Figure 7:
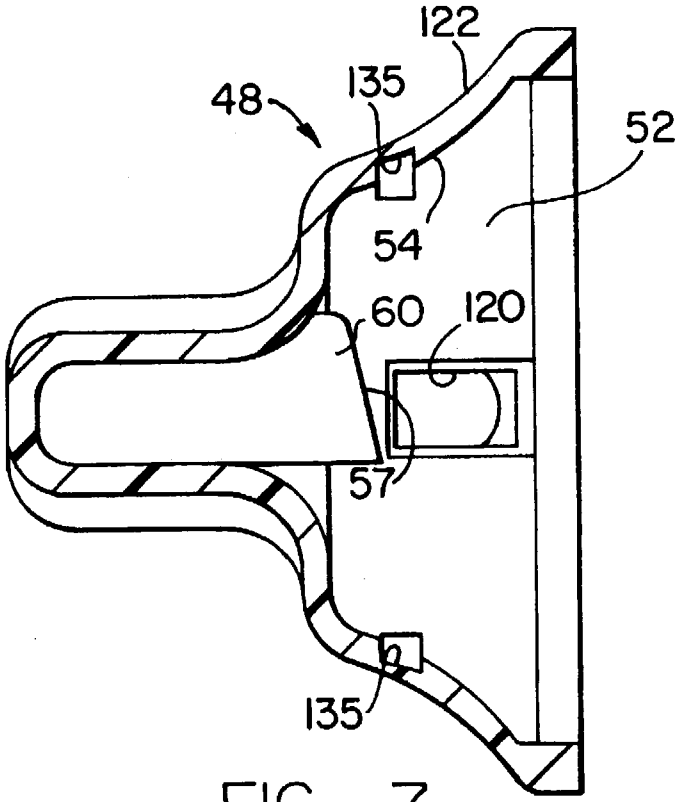
FIG. 7 is a sectional, view of the knob of the present invention taken through line 7—7 in FIG. 6.
Figure 10:
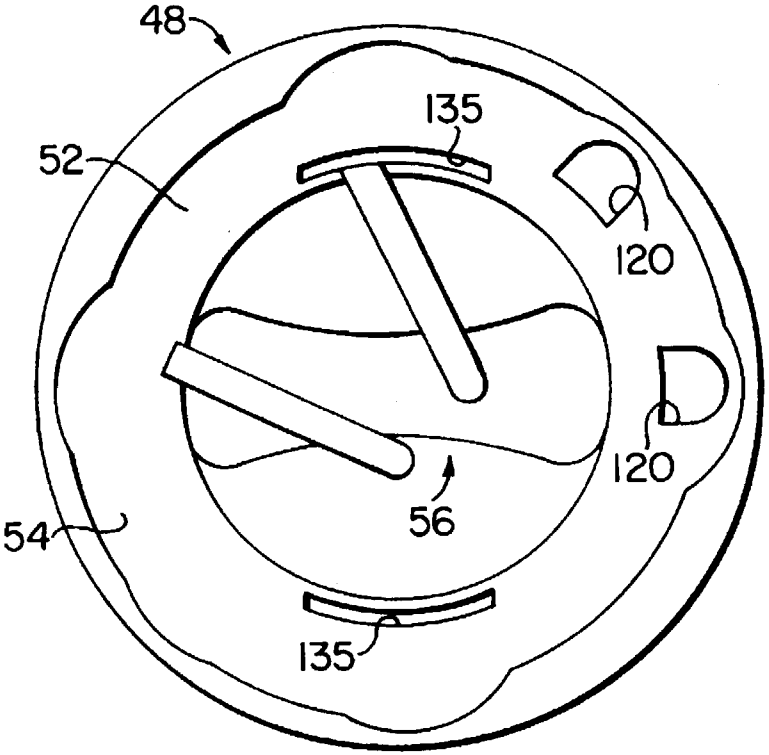
FIG. 10 is a bottom view showing the interior structure of an embodiment of the knob of the present invention.

Referring to FIGS. 5 through 10, several different cam combinations contained within the knob interior cavity are therein shown. FIG. 8 illustrates the cam combination for the two position or "OFF-ON" switch of the first embodiment of the present invention. When the knob 48 is rotated, the sloped surface 57 of a respective one of the cams 60 or 61 engages the upper section 98 of the rocker 44, thereby causing the actuator to pivot, resulting in movement of the movable contact 36 as shown in FIG. 1.

Figure 9:
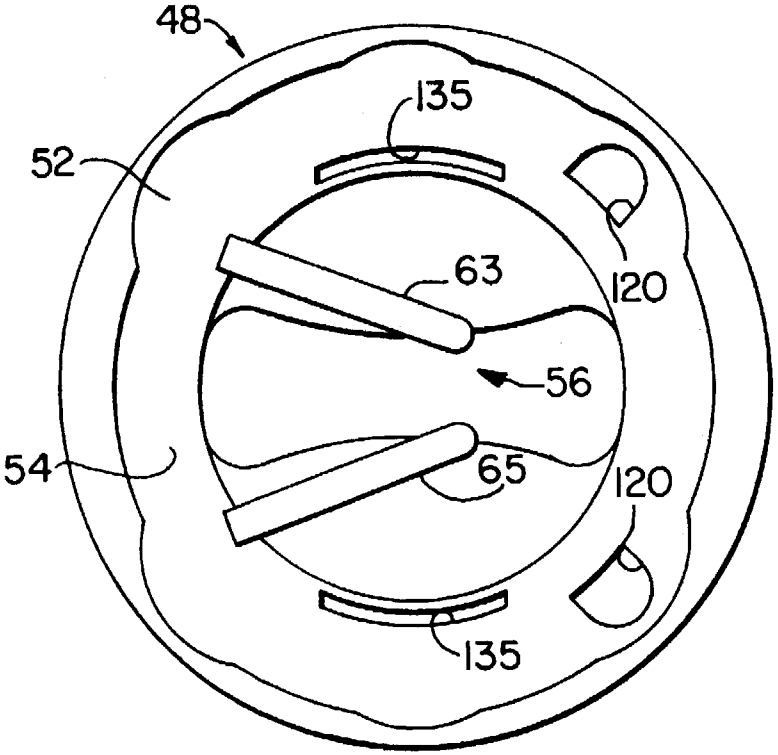
FIG. 9 is a bottom view showing the interior structure of an embodiment of the knob of the present invention.
Figure 12:
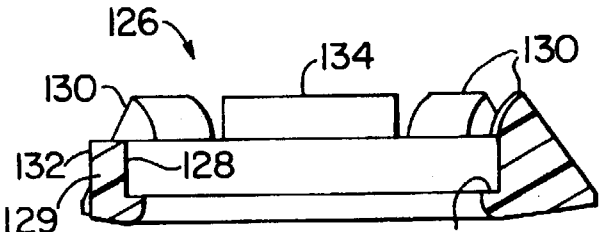
FIG. 12 is a sectional view of the lens retainer of the present invention taken through line 12—12 of FIG. 11.
Figure 13:
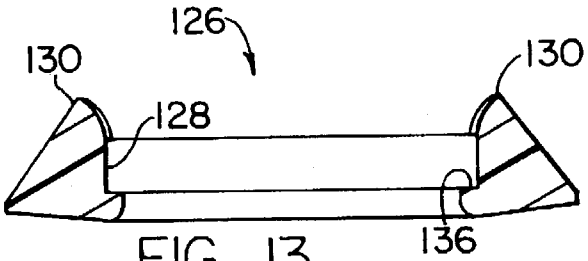
FIG. 13 is a sectional view of the lens retainer of the present invention taken through line 13—13 of FIG. 11.
Figure 14:
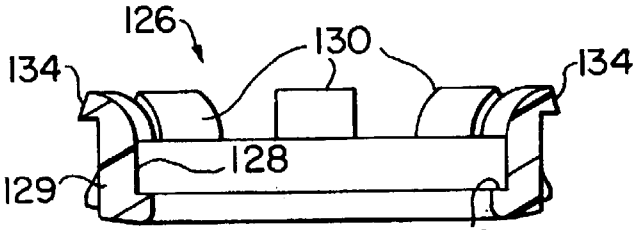
FIG. 14 is a sectional view of the lens retainer of the present invention taken through line 14—14 of FIG. 11.
Figure 11:
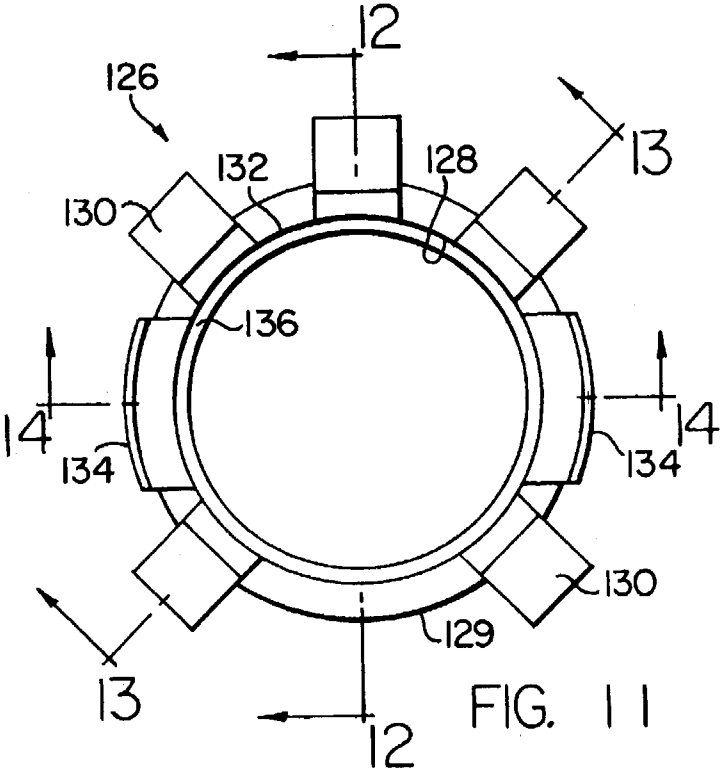
FIG. 11 is a top view of the lens retainer of the present invention.
Figure 18:
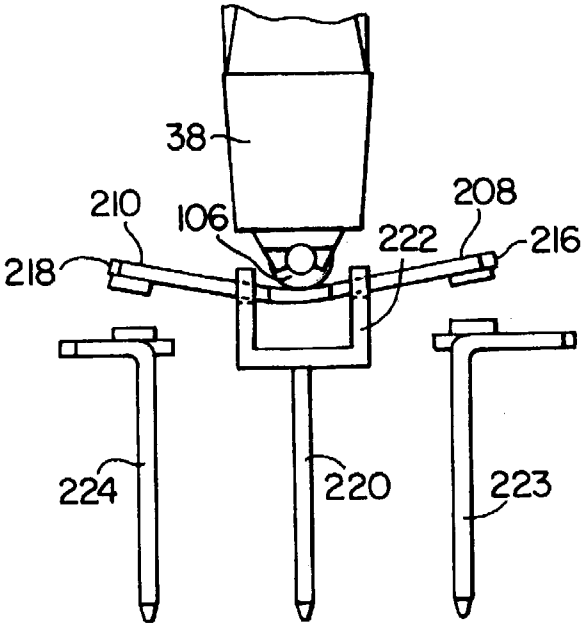
FIG. 18 is a front elevational view, partly in vertical section of an alternate three position switch with the actuator shown in a stable "center-off" position.

FIG. 9, illustrates a cam combination for a second embodiment of the present invention, a three position "ON-OFF-ON" switch. Referring to FIGS. 9 and 18, when the actuator 38 is in the center or OFF position as shown in FIG. 18, the wheel 106 is urged by the spring biased plunger 102 against the movable contact 208. The center contact 220 defines a yoke portion 222 that is bifurcated and defines two fulcrums for the movable contact 208. Both the actuator 38 and the movable contact 208 are held in the "OFF" position. Therefore, during actuation of the switch, the actuator and movable contact are interrupted in their movement between their limit positions and define the previously described center "OFF" position. The knob 48 has a stable position between the first and second limit positions which corresponds to the center off position such that the movable contact free ends are held out of engagement with the another and third fixed contacts. Upon rotation of the knob 48 from the stable center "OFF" position to a first limit or "ON" position, cams 63 and 65 coact with the upper section 98 of the rocker 44 to cause the actuator 38 to pivot. This results in the roller 106 moving along the movable contact upper surface 210, FIG. 18, thereby causing the movable contact 208 to rotate in a first direction about the second fixed contact 220 which acts as a fulcrum. When the corresponding limit position is reached, a free end 216 of the movable contact 208 engages the third fixed contact 223. Conversely, if the knob 48 is selectively rotated to a second limit position, cams 63 and 65 engage and coact with the upper portion 98 of the rocker 44 causing the movable contact 208 to rotate in a second direction about the second fixed contact 220 thereby resulting in the engagement of an opposite free end 218 of the movable contact 208 and the first fixed contact 224, FIG. 18. It should be understood that the present invention is not limited to the cam configurations illustrated, and that other configurations may be used without departing from the broader aspects of the present invention.

Figure 15:
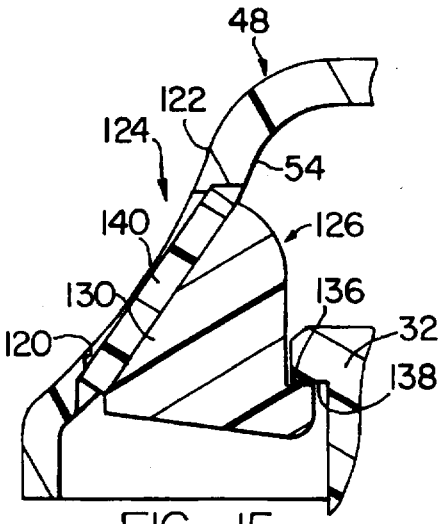
FIG. 15 is a partial sectional view of the knob showing the lens retainer and lens of the present invention.

Referring to FIG. 15, the knob 48 also includes at least one opening 120 extending from exterior surface 122 into the interior knob cavity 52. A lens 124 made of a suitable material, such as, but not limited to polycarbonate, is adapted to be received in the opening 120. A lamp 125, FIG. 1, is carried by the bracket 32 and is visible through the opening 120 when the knob is in a limit position. While a lamp is shown and described, many other types of indicating means known to those skilled in the art such as, for example, light emitting diodes (LED's) may be substituted without departing from the broader aspects of the present invention.

Figure 16:
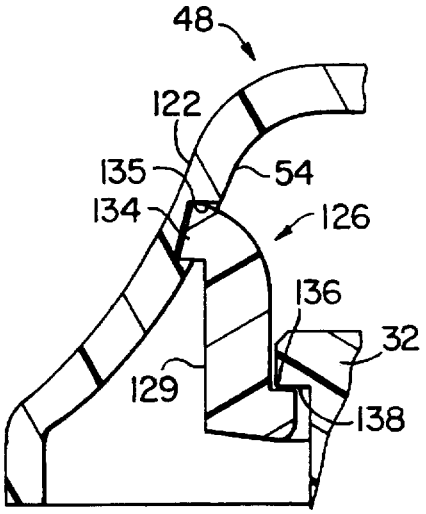
FIG. 16 is a partial sectional view of the knob showing the lens retainer positioned in the knob of the present invention.

In addition to the foregoing, various different versions of the lens 124, and the means by which it is retained in the opening 120 may be employed, one such other version is shown in FIGS. 11 through 15 where a cylindrical lens retainer 126 includes a cylindrical member 129 having a central bore 128 extending therethrough. At least one preferably transparent tab portion 130 extends from an outer periphery 132 of the lens retainer 126 and is adapted to be received in the opening 120 of the knob 48. Upper flange sections 134, FIG. 16, are carried by and extend radially outwardly from the cylindrical member 129 and are receivable in a recess 135, FIG. 16, in the interior knob cavity wall 54, thereby attaching the lens retainer 126 to the knob 48. A lower flange 136 radially extends from the cylindrical member 129 into the bore 128 and is positioned under a lip portion 138, FIGS. 15 and 16, extending from the bracket 32, thereby rotatably retaining the knob 48 on the switch.

Referring to FIG. 15, at least one transparent colored lens 140, FIG. 15, can be interposed between the lens retainer 126 and the knob opening 120. When the switch is actuated, the opening 120 is aligned with the lamp 125, FIG. 1. As the light from the lamp passes through the transparent colored lens 140, the switch position is indicated.

Figure 19:
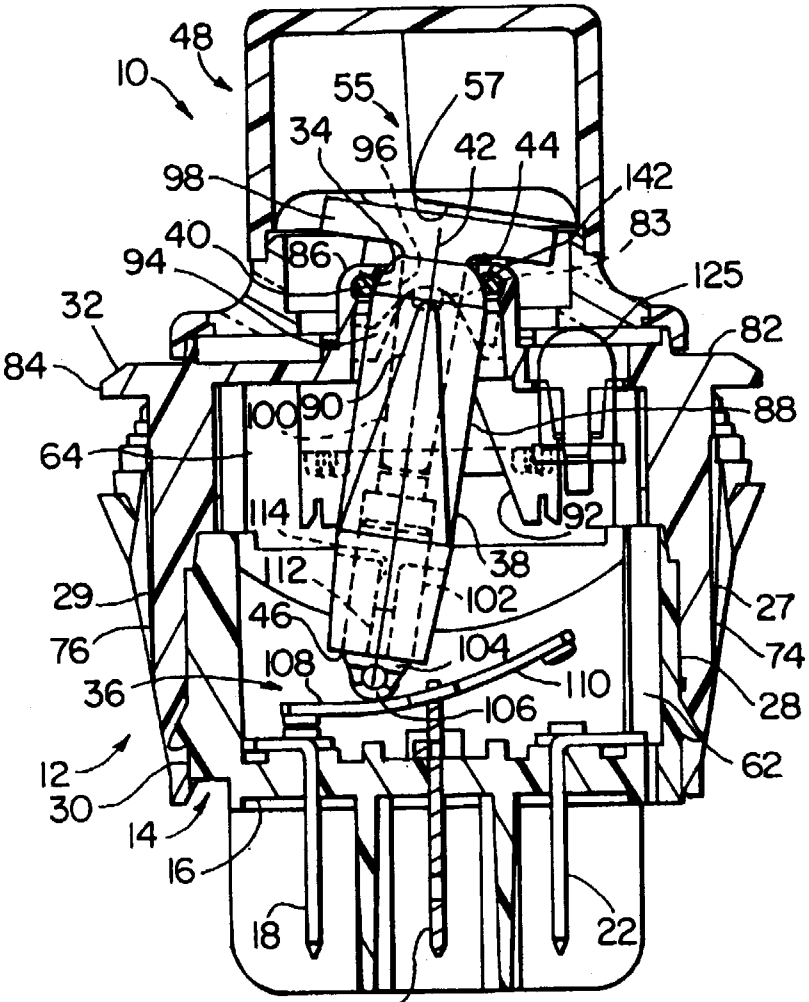
FIG. 19 is a front elevational view, partly in vertical section of an alternate embodiment of a rotary switch of the present invention.

Turning now to FIG. 19, in a third embodiment of the present invention, the switch as described herein has a switch case 12, comprising two half sections, one part is the lower base which supports the terminals as well as the fixed and movable contacts inside the switch cavity, and the other part comprises a mounting bracket which mates with the base and defines the top wall of the switch cavity, The geometric fit of the base to the bracket effectively seals the sides of the switch case cavity from external environmental hazards. The upstanding boss 86 of the mounting bracket is so configured as to receive means connecting or coupling the rocker to the actuator. Such means preferably comprises a raised center portion of the actuator that in turn defines a central opening 96 for receiving the depending post 100 on the rocker 44. An O-ring 142 is preferably provided in the gap between the boss on the center portion of the actuator 38. The post 100 is of a lesser diameter than the opening 96 in the actuator to allow an amount of non-binding movement of the post into and out of the opening 96. This clearance allows pivoting movement to be transferred from the rocker to the actuator, yet prevents the transfer of pressure which may force the actuator into the switch housing and compromise the integrity of the seal provided by the spring biased plunger 102 exerting pressure through the raised center portion of the actuator and compressing the O-ring 142 against the bracket boss 86. The upper edge of the shoulders 90 of the actuator cooperate with the limit stops 92 of the mounting bracket so that the space provided for the O-ring seal is maintained constant during actuation, thereby allowing consistent compression of the O-ring maximizing the sealing effectiveness and minimizing wear of the O-ring.

While preferred embodiments have been shown and described, various modifications and substitutions may be made without departing from the spirit and scope of the invention. Accordingly, it is to be understood that the present invention has been described by way of example and not by limitation.

I claim:

1. An electric switch comprising:

a switch case having an enclosed switch cavity defined by a bottom wall in which openings are provided for terminals, laterally spaced front and rear walls, opposed end walls integrally connected to said bottom wall and to each other, and a top cover in communication with said front, rear, and opposed end walls, said top cover having a central opening extending therethrough and defining a socket therein;

at least one movable contact provided in said enclosed switch cavity;

an actuator positioned in said enclosed switch cavity and having, a shoulder portion in pivotal communication with said socket for movement on a lateral pivot axis, a downwardly depending portion in communication with said at least one movable contact, and an upwardly extending portion extending from said shoulder, through said top cover aperture said upwardly extending portion including an upper section;

a knob rotatably mounted on said switch case on an axis oriented perpendicular to said lateral pivot axis of said actuator; and cam means defined in part by said actuator upwardly extending portion and in part by said knob such that rotation of said knob causes said actuator shoulder to pivot in said socket to at least one predetermined limit position, and said downwardly depending portion to move said movable contact toward said at least one predetermined limit position; and said knob further including a downwardly open interior knob cavity defined by a cavity wall, an exterior surface, and at least one opening in said exterior surface extending through said cavity wall into said interior knob cavity; and wherein said top cover has an upper surface, and at least one indicating means carried by said upper surface and is visible through said at least one opening.

2. The electric switch of claim 1 further characterized by fixed contacts in said bottom wall, said one movable contact being supported on one of said fixed contacts for pivotal movement between first and second limit positions in response to rotation of said knob and wherein said one movable contact has a free end for engaging another of said fixed contacts, a fulcrum defining fixed contact defining a fulcrum for said movable contact so that said movable contact free end is positively moved away from said another fixed contact when said knob is rotated, said actuator including a biased element acting between it and said movable contact to provide a positive toggle action between said fixed and movable contacts thereby providing positive action upon rotation of said knob.

3. The electric switch of claim 1 wherein said case, front, rear, lateral, and bottom walls define an upwardly open cavity;

said top cover comprises a mounting bracket having a top wall and laterally spaced front and rear walls adapted to mate with said case front and rear walls respectively, said bracket having opposed walls integrally connected to said front and rear walls thereof to define a downwardly open cavity in communication with said upwardly open cavity thereby forming said enclosed switch cavity; and said bracket top wall defining a center rib portion in which said socket is defined.

4. The electric switch of claim 1 wherein said enclosed switch cavity is hermetically sealed and a seal is provided between said shoulder portion of said actuator and said socket.

5. The electric switch of claim 1 wherein an O-ring seal is provided in said central opening of said top cover.

6. The electric switch of claim 1 wherein said knob is selectively rotatable between a first limit position and at least a second limit position; and wherein said cam means includes first and second cam portions formed integrally with said cavity wall and extending into said knob interior cavity; and said first and second cam portions are slidably engaged with said upper section of said actuator upwardly extending portion such that when said knob is rotated from an off position to said first position, said first cam portion and said upper section of said upwardly extending portion coact to cause said downwardly depending portion to pivot said movable contact in a first direction toward said first limit position, conversely when said knob is rotated to said second position, said second cam portion and said upwardly extending portion coact to cause said downwardly depending portion to pivot said movable contact in a second direction toward said second limit position.

7. The electric switch of claim 6 further characterized by a third fixed contact in said bottom wall arranged opposite said another fixed contact, said one movable contact being supported on said one fulcrum defining fixed contact for pivotal movement to said second limit position wherein an opposite free end of said movable contact engages said third fixed contact when said knob is selectively rotated to said second position.

8. The electric switch of claim 7 wherein said fixed fulcrum defining contact has an upper end that supports said movable contact in a stable center "OFF" position, said actuator and movable contact being interrupted in movement between their limit positions to define a center "OFF" position, and said knob having a stable position between said first and second limit positions such that said movable contact free ends are held out of engagement with said another and said third fixed contacts.

9. The electric switch of claim 1 wherein said knob further includes at least one lens means positioned in said at least one opening.

10. The electric switch of claim 9 wherein said indicating means comprises a lamp supported in a lamp opening defined by said top cover.

11. The electric switch of claim 10 wherein said lens means comprises a cylindrical member having a central bore;

at least one transparent tab portion extending from an outer periphery of said cylindrical member and adapted to be received in said at least one opening, an upper flange extending radially outwardly from said cylindrical member and adapted to be received in a second recess in said interior cavity wall thereby attaching said lens means to said knob, and a lower flange radially extending from said cylindrical member into said bore, said lower flange being positioned under a lip portion extending from said top cover thereby rotatably retaining said knob on said top cover.

12. The electric switch of claim 11 wherein a colored lens is interposed between said opening and said lens means.

13. The electric switch of claim 1 wherein said actuator further comprises:

a roller in communication with said one movable contact and rotatably mounted to said downwardly depending portion;

said downwardly depending portion including at least one spring biased plunger received in a downwardly open plunger cavity defined by said actuator for urging said roller against said movable contact, and said upwardly extending portion including a post extending above said top cover; and said post being received in an upwardly open recess provided for said actuator.

14. The electric switch of claim 13 wherein said knob further includes at least one lens means positioned in said opening.

15. The electric switch of claim 14 wherein said knob interior cavity is defined by a cavity wall and said lens means comprising:

a cylindrical lens retainer having a central bore; and at least one transparent tab portion extending from an outer periphery of said lens retainer and positioned in said opening, an upper flange extending radially outwardly from said cylindrical member and adapted to be received in a recess in said interior cavity wall thereby attaching said lens retainer to said knob, and a lower flange radially extending from said cylindrical member into said bore, said lower flange being positioned under a lip portion extending from said top cover thereby rotatably retaining said knob on said top cover.

16. The electric switch of claim 15 further comprising a colored lens positioned in front of said lens retainer.

17. An electric switch comprising:

a switch case having an enclosed switch cavity defined by a bottom wall in which openings are provided for terminals, laterally spaced front and rear walls, opposed end walls integrally connected to said bottom wall and to each other, and a top cover in communication with said front, rear, and opposed end walls, said top cover having a central opening extending therethrough and defining a socket therein;

at least one movable contact provided in said enclosed switch cavity;

an actuator positioned in said enclosed switch cavity and having, a shoulder portion in pivotal communication with said socket for movement on a lateral pivot axis, a downwardly depending portion in communication with said at least one movable contact, and an upwardly extending portion having an upper section, extending from said shoulder, through said top cover aperture; and a knob rotatably mounted on said switch case on an axis oriented perpendicular to said lateral pivot axis of said actuator, said knob defining an interior cavity having a cavity wall and cam means extending from said cavity wall and defining sloped surfaces positioned above and slidably engaged with said upper section of said upwardly extending portion such that during rotation of said knob said sloped surfaces progressively engage said upper section of said upwardly extending portion causing said actuator shoulder to pivot in said socket to at least one predetermined limit position, and said downwardly depending portion to move said movable contact toward said at least one predetermined limit position.

18. The electric switch of claim 17 wherein said knob further includes:

an exterior surface and a downwardly open interior cavity; and at least one opening in said exterior surface extending into said interior cavity.

19. The electric switch of claim 18 wherein said top cover has an upper surface, and at least one indicating means located on said upper surface and visible through said at least one opening.

* * * * *